US005477202A

United States Patent [19]

Zarembo et al.

[11] Patent Number: 5,477,202

[45] Date of Patent: Dec. 19, 1995

[54] DEACTIVATING DEVICE FOR MAGNETIC MARKERS IN AN ELECTRONIC ARTICLE SURVEILLANCE SYSTEM

[75] Inventors: Peter J. Zarembo, Shoreview; Thomas J. Brace, Minneapolis, both of Minn.; John H. Kindschy, Hudson, Wis.

[73] Assignee: Minneaota Mining and Manufacturing Company, St. Paul, Minn.

[21] Appl. No.: 495,146

[22] Filed: Jun. 27, 1995

Related U.S. Application Data

[63] Continuation of Ser. No. 225,750, Apr. 11, 1994, abandoned, which is a continuation of Ser. No. 209,699, Mar. 10, 1994, abandoned.

[51] Int. Cl.[6] ..... H01F 7/20; G08B 13/24

[52] U.S. Cl. ..... 335/284; 340/551; 340/572

[58] Field of Search ..... 335/284, 285–298, 335/302–306; 340/551, 572; 248/206.5, 309.4; 269/8

[56] References Cited

U.S. PATENT DOCUMENTS

| | | | |
|---|---|---|---|
| 4,499,444 | 2/1985 | Heltemes et al. | 335/284 |
| 4,665,387 | 5/1987 | Cooper et al. | 340/572 |
| 4,684,930 | 8/1987 | Minasy et al. | 340/551 |
| 4,689,590 | 8/1987 | Heltemes | 335/284 |
| 4,752,758 | 6/1988 | Heltemes | 335/284 |
| 4,881,061 | 11/1989 | Chambers | 340/568 |
| 5,126,720 | 6/1992 | Zhou et al. | 340/572 |
| 5,187,462 | 2/1993 | Montean | 335/284 |
| 5,225,807 | 7/1993 | Zhou et al. | 340/551 |
| 5,285,182 | 2/1994 | Zarembo | 335/284 |

FOREIGN PATENT DOCUMENTS

| | | | |
|---|---|---|---|
| 0129335 | 12/1984 | European Pat. Off. | G08B 13/24 |
| 0134404 | 3/1985 | European Pat. Off. | G08B 13/24 |
| 0585891A1 | 3/1994 | European Pat. Off. | G08B 13/24 |

OTHER PUBLICATIONS

3M Tattle–Tape™ Library Security Systems Brochure, 1994.

3M Shoplifting Control Program Brochure, 1991.

*Primary Examiner*—Leo P. Picard
*Assistant Examiner*—Raymond M. Barrera
*Attorney, Agent, or Firm*—Gary L. Griswold; Walter N. Kirn; Kari H. Bartingale

[57] ABSTRACT

A deactivating device for magnetic markers in an electronic article surveillance (EAS) system includes a housing adapted to constrain typical audio and video cassettes in preferable orientations with respect to first and second deactivating surfaces. The first deactivating surface includes a first magnetic insert, which includes a first magnet designed to produce a deactivating magnetic field which deactivates markers affixed to audio and/or video cassettes without causing audible signal degradation of the prerecorded magnetic media within the audio or video cassette. The second deactivating surface includes a second magnetic insert and second magnet designed to produce a deactivating magnetic field which deactivates markers placed in the recessed edge of video cassette without causing audible signal degradation of the prerecorded magnetic media contained in the video cassette. An alternate magnetic insert which can be substituted for the first and second magnetic inserts is also described.

21 Claims, 9 Drawing Sheets

DEACTIVATING DEVICE FOR MAGNETIC MARKERS IN AN ELECTRONIC ARTICLE SURVEILLANCE SYSTEM

This application is a continuation of application Ser. No. 08/225750, filed Apr. 11, 1994, now abandoned, which is a continuation of application Ser. No. 08/209699, filed Mar. 10, 1994, now abandoned, and entitled Deactivating Device for Magnetic Markers in an Electronic Article Surveillance System.

TECHNICAL FIELD

This invention relates to a deactivating device for markers in an electronic article surveillance (EAS) system and more particularly to a deactivating device adapted to deactivate markers on articles, such as prerecorded audio and video cassettes, without producing levels of signal degradation that are audibly or visually perceptible by humans.

BACKGROUND

Libraries and retail stores often use electronic article surveillance (EAS) systems to protect articles such as books or prerecorded magnetic video and audio cassettes from unauthorized removal. Dual-status magnetic EAS markers are a good choice for this application, but the relatively large magnetic fields required to deactivate the markers is more than sufficient to degrade the prerecorded magnetic signals on audio or video cassettes to a degree that is audibly or visually perceptible by human beings. Such effects, including print through and partial erasure, are highly undesirable.

Dual-status magnetic EAS markers typically comprise a layer or strip of high permeability magnetic material and one or more segments or layers of remanently magnetizable members adjacent the high permeability material. When the remanently magnetizable members are in a demagnetized state, they do not magnetically interact with the high permeability material, and can be reversibly driven between oppositely directed saturated magnetized states in response to the interrogation field from an EAS detection system, providing a detectable signal in the system. When the remanently magnetizable members are in the proper remanently magnetized state, they provide stronger magnetic fields to the high permeability material than the interrogation fields, and retain it in a constant magnetized state and prevent it from being reversibly driven between oppositely directed saturated magnetized states and providing a detectable signal. Thus, the dual-status markers are deactivated by remanently magnetizing the remanently magnetizable members.

The deactivating process typically involves properly orienting the marker and then passing it through a magnetic field with deactivating components along the direction of translation. Deactivating devices preferably provide magnetic fields which are constant in time, spatially uniform in the transverse direction over the extent of the deactivator, and spatially varying in the other two directions. The longitudinal component of the magnetic field at the surface contacting the marker should be at least 1.4 times the (200 to 350 Oe.) coercive force of the remanently magnetizable marker material to assure adequate remanent magnetization. However, such a magnetic field will result in undesirable levels of signal degradation of the recorded signal on a typical audio cassette (having a typical coercive force of about 300 Oe.) or even a video cassette (having a typical coercive force from 550–1300 Oe.). Self-demagnetizing fields associated with a cassettes own recorded magnetization patterns, as well as magnetic fields from the recorded patterns on adjacent layers of the tape, also affect the recorded signal. When the magnetic fields from the deactivating device are superimposed on the fields originating from the magnetic media, they act as an effective bias in promoting self-demagnetization and the imaging or printing of the magnetic field patterns from adjacent layers. For example, it has been found that for the prerecorded magnetic tape in audio cassettes, a magnetic field from the deactivating device as low as 100 Oe will result in levels of signal degradation that are perceptible by humans.

To avoid such deleterious effects on prerecorded magnetic media, it is also known to provide apparatus in which a steady-state field is produced which rapidly decreases in intensity with increased distance from the apparatus. Thus, such an apparatus improves the likelihood of magnetizing the higher-coercive force sections of a marker brought close thereto without interfering with the magnetic signals recorded on tapes within a cassette to which the marker is affixed. For example, the apparatus described in U.S. Pat. No. 4,499,444 to Heltemes et at. has generally been found to be satisfactory so long as it is used with markers of a single type, and whose magnetizable components all have a coercive force within a given range, such that the field intensity at the working surface of the apparatus is controlled to appropriately magnetize those components while not adversely affecting magnetically sensitive articles. Conversely, it has been found that when the apparatus is used with markers nominally of the same type, but in which the value of the coercive force varies over a relatively wide range of allowed values, certain conditions may cause unsatisfactory results.

To prevent adverse effects on magnetically sensitive articles with which the markers are desirably used, the field intensity at some distance from the working surface of the apparatus at which such magnetically sensitive articles are to be located must be below certain design limits. However, a practical apparatus desirably has an effective operable range extending a short distance above the surface within which all allowed materials must become magnetized. Some markers having coercive forces near the highest allowed value and positioned near the outer edge of the allowed range, i.e., in the weakest fields, may not become sufficiently magnetized. And, since known deactivating devices include a reverse directed back field, which is particularly strong near the surface of the apparatus, such back fields may be sufficient to reduce the magnetization state in markers near the surface and having coercive forces near the lowest allowed value. Such reduced magnetization levels could, in turn, inadequately bias the low coercive force, high permeability material of the marker, such that the response of the marker would be inadequately altered. Such effects are further compounded if markers of significantly different types, each having magnetizable materials having coercive forces in significantly different ranges are used with the same apparatus.

The widely varying geometries presented by articles to which markers are commonly attached also present special problems. For example, protruding or recessed portions of many articles prevent placement of the article flat against a deactivating surface. This results in parts of the article being located farther away from the deactivating surface such that a marker placed there may not be properly deactivated. The typical audio and video cassettes are examples of such articles which present geometries where this problem commonly arises.

The different types of markers used in EAS systems have magnetizable elements in a range of coercive forces. For example, one type of marker has a magnetizable element with a coercive force in the range of 24,000–28,000 A/m (300 to 350 oersteds), a second type has a magnetizable element with a coercive force in the range of 14,400–18,400 A/m (180 to 230 oersteds), and a third type has a magnetizable element with a coercive force in the range of 4,800–7,200 A/m (60–90 oersteds). Such markers may, for example, be type QT Quadratag™, Type WH-0117 Whispertape™ and type QTN Quadratag™ markers, respectively, all of which are sold by Minnesota Mining and Manufacturing Company (3M), St. Paul, Minn.

In addition to the signal degradation, currently available deactivating devices also suffer from ergonomic problems. Often a person is required to repetitively deactivate markers on multiple articles over an extended period of time. The repetitive picking up, twisting, translating, and setting down of articles required to deactivate the markers is the type of repetitive motion associated with hand, arm, and wrist fatigue, and, in the worst case, Carpal Tunnel Syndrome. Thus, an ergomonic housing design which alleviates this problem would be highly desirable.

It would therefore be desirable to have a deactivating apparatus whose magnetic field strength decreased rapidly away from the magnet assembly, which is adapted for deactivation of markers on both audio and video cassettes such that any signal degradation of the associated prerecorded magnetic media is not audibly or visually perceptible to human beings. Other features which would be desirable in a deactivating device include a low profile, ergonomically designed housing such that adverse physical effects on a human operator and interference with other checkout procedures are minimized, and which requires fewer components and less material than presently known devices.

SUMMARY

The present device deactivates dual-status magnetic electronic article surveillance (EAS) markers affixed to either prerecorded audio or video cassettes, without producing perceptible levels of signal degradation of the prerecorded magnetic signal. The device is designed such that an article will be placed in a defined orientation, with the surface to which the marker is affixed placed on a deactivating surface. The article is then translated across the device in either direction. The deactivating device has a first deactivating surface adapted for use with EAS markers affixed to prerecorded audio or video cassettes and a second deactivating surface adapted for use with EAS markers affixed in a recessed edge of video cassettes. When either type of cassette is properly positioned and translated across an appropriate deactivating surface, the remanently magnetizable portions of the associated marker will be subjected to a magnetic field of sufficient strength to become remanently magnetized, deactivating the marker, but which also has a magnetic field gradient such that no perceptible signal degradation of the associated magnetic media occurs.

The first surface includes a first magnetic insert for the deactivation of markers on audio or video cassettes. The first magnetic insert includes a first magnet having a length substantially perpendicular to the direction the article is moved across the housing, and provides magnetic field components which are aligned substantially normal to its length. The second surface includes a second magnetic insert for the deactivation of markers placed in a recessed portion of a side edge of a video cassette. The second magnetic insert includes a second magnet having a length substantially perpendicular to the direction in which the article is moved across the device. The magnetic fields of both the first and second magnetic inserts are adjusted to have magnitude and field gradient which deactivates a marker without resulting in perceptible signal degradation of the prerecorded magnetic media contained within the article to which the marker is affixed. In addition, the magnetic field does not subject the marker to a back field which would partially resensitize the marker. The device is appropriate for deactivating many different types of markers and is provided in an ergonomic housing.

BRIEF DESCRIPTION OF THE DRAWINGS

The various objects, features, and advantages of the present deactivating device will be understood upon reading and understanding the following detailed description and accompanying drawings, in which.

DETAILED DESCRIPTION

Figure 1A:
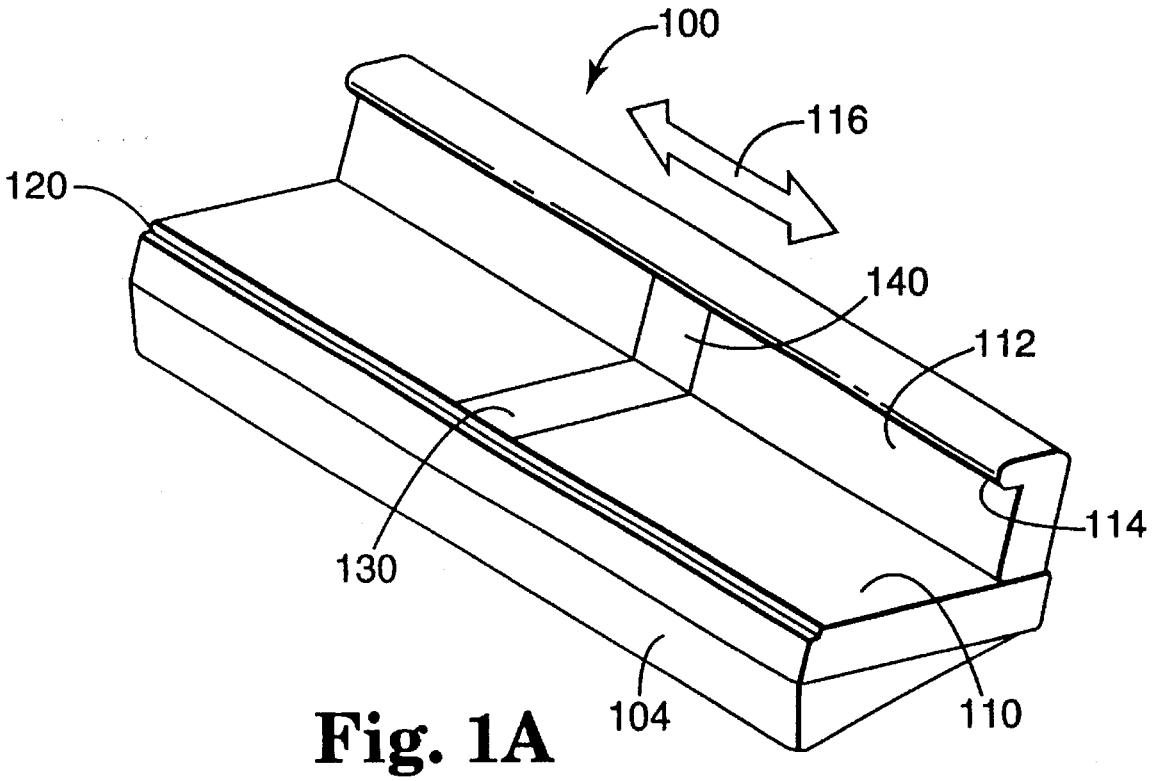
FIGS. 1A and 1B are a perspective and a side view of the present deactivating, respectively.
Figure 1B:
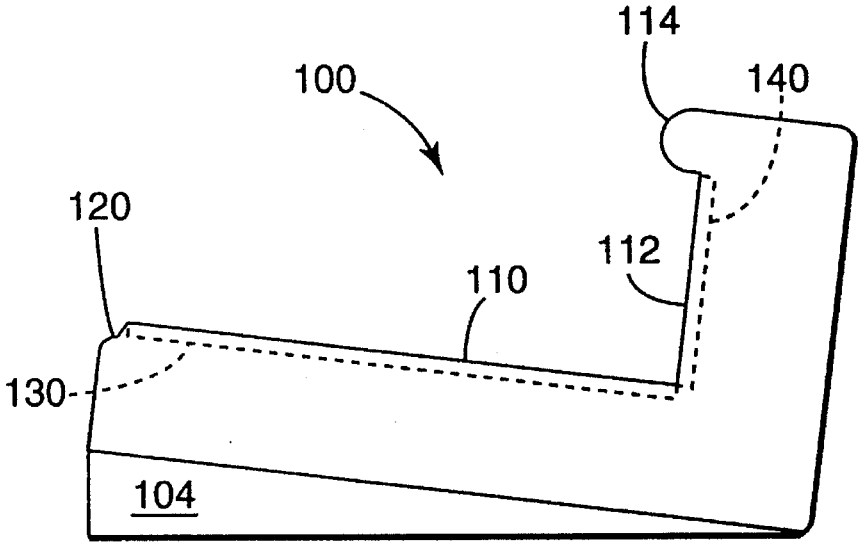

The present deactivating 100, shown in perspective view in FIG. 1A and in side view of FIG. 1B, has a first deactivating surface 110 with an embedded first magnetic insert 130, and a second deactivating surface 112 orthogonally intersecting the first deactivating surface 110 and having an embedded second magnetic insert 140. A marker can be deactivated by moving the article to which it is affixed across the device in either direction indicated by arrow 116.

The present deactivating device is designed to deactivate a marker without causing perceptible levels of signal degradation to any prerecorded magnetic media which may be contained within the article to which the marker is affixed. Examples of such articles include prerecorded audio and video tapes.

As such, the first deactivating surface 110 deactivates markers on any article, but the deactivating magnetic field provided is specifically calibrated to ensure below perceptible levels of signal degradation of both audio and video cassettes. Second deactivating surface 112 provides a deactivating magnetic field having a lower magnetic field gradient than that provided by first deactivating surface 112.

In order to accommodate the specific geometry of the typical audio and video cassette to ensure proper reactivation of any marker affixed thereto, guide portions are provided by the housing of the present deactivating device. These guide portions are shown in FIGS. 1A and 1B as notched edge 120 and protruding edge 114. Notched edge 120 along one side of surface 110 designed to accommodate a raised side portion of a typical audio cassette as described below with respect to FIG. 3B. Protruding edge 114 is designed to accommodate a side edge of a typical video cassette as described below with respect to FIG. 3A. Another function of protruding edge 114 is to prevent a vertically positioned audio cassette from coming too close to surface 112, so that the prerecorded magnetic media contained within an audio cassette is not subjected to a magnetic field which would cause audible levels of signal degradation. The housing 104 of the apparatus 100 is preferably constructed of non-magnetic materials such as extruded aluminum, and may also be fabricated from appropriately dimensioned and finished hardwood or may be formed from injection molded plastic. Bevelled faces provided in the housing 104 may be utilized to carry appropriate legends, manufacturer identification, instructions and the like.

Figure 2A:
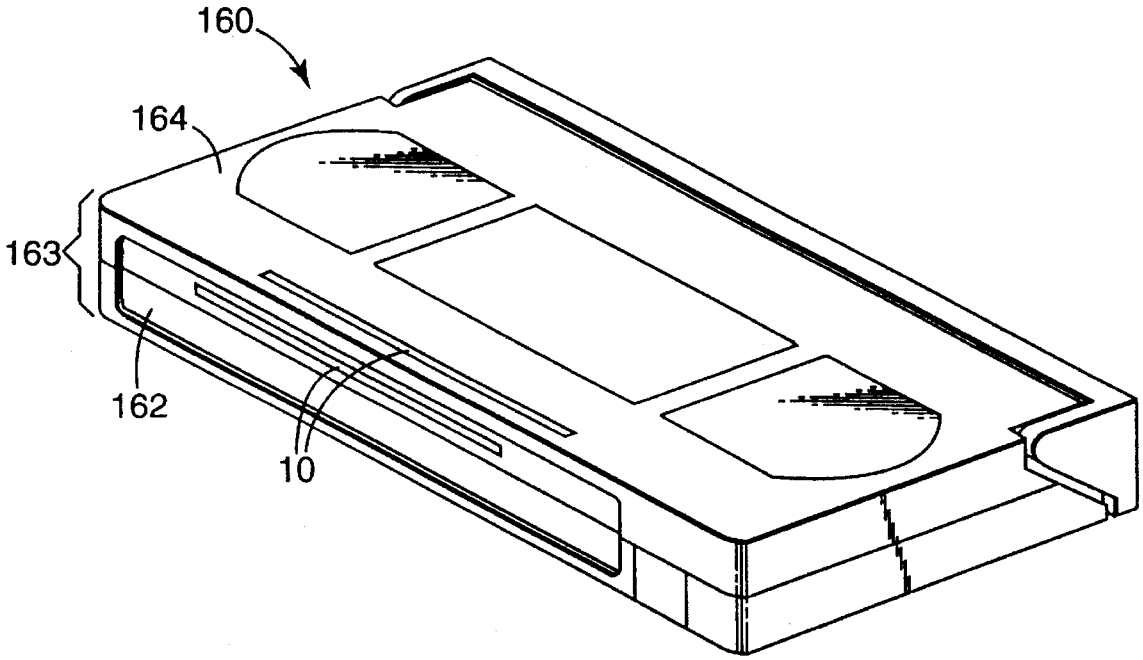
FIGS. 2A and 2B show a typical video cassette and a typical audio cassette, respectively.
Figure 2B:
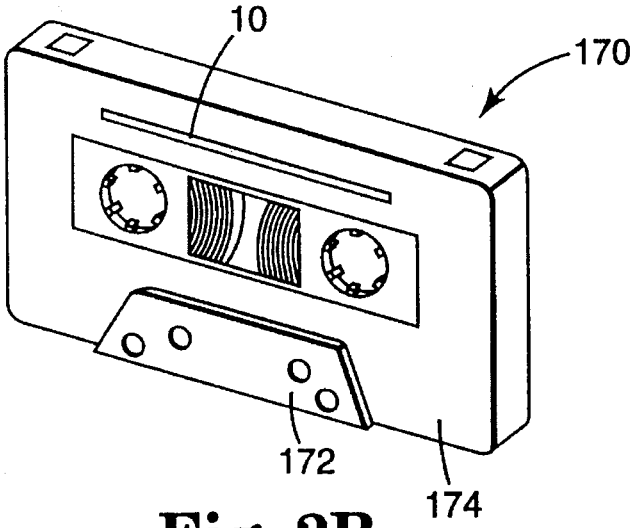

FIGS. 2A and 2B show perspective views of a typical video cassette and a typical audio cassette, respectively. In practice, a marker 10 will typically be placed either on broad surface 164 or in recessed portion 162 on side edge 163 of a video cassette 160. Recess 162 on a typical video cassette is recessed to a depth of about 0.75 mm to accommodate a means of identification such as a label. The typical audio cassette of FIG. 2B includes a flat surface 174 and a raised side portion 172. In practice, a marker 10 is typically placed on the flat surface 174 of an audio cassette 170.

Figure 3A:
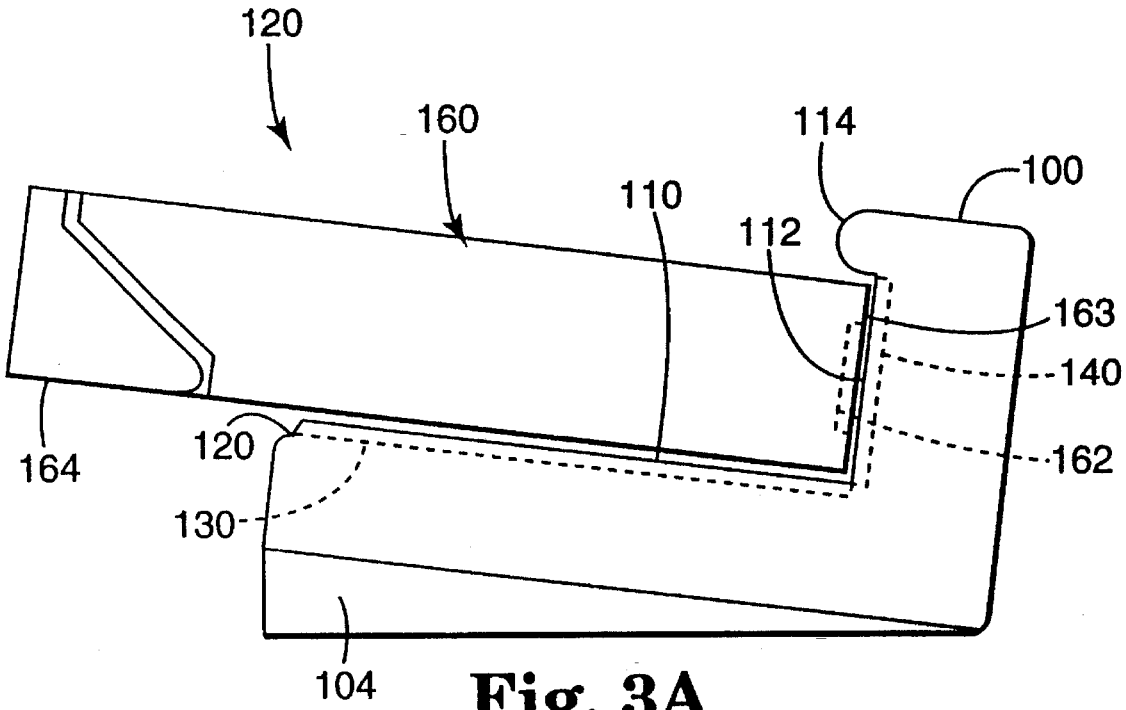
FIGS. 3A and 3B show the placement of a typical video cassette and a typical audio cassette on the present deactivating device.
Figure 3B:
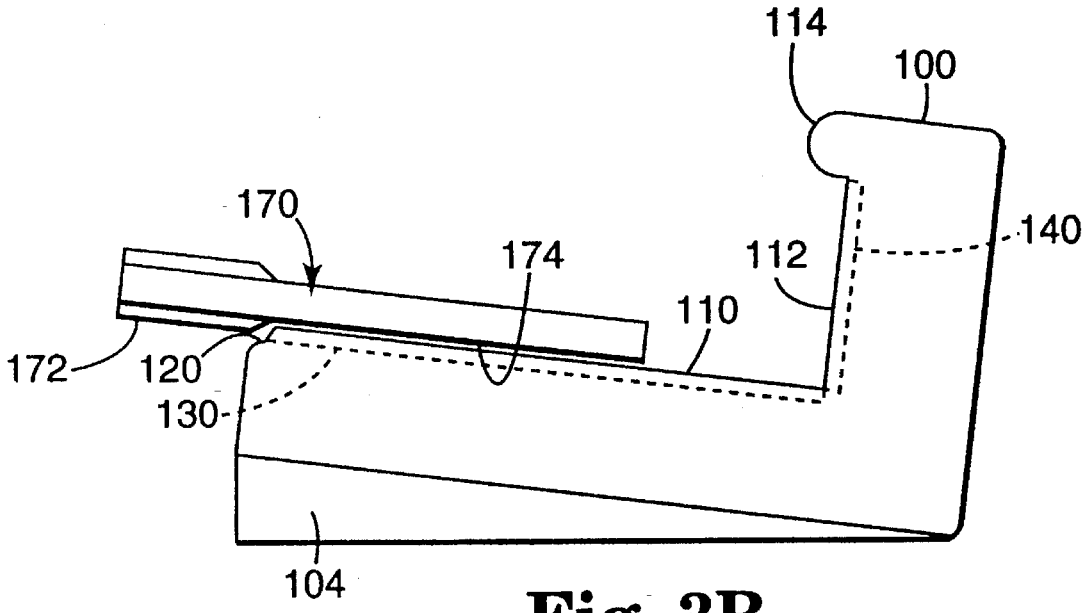

FIGS. 3A and 3B are end views of the present deactivating device showing the preferred placement of a video cassette and an audio cassette thereon. FIG. 3A shows a typical video cassette positioned on the present deactivating device such that broad surface 164 is substantially in contact with first deactivating surface 110, and side edge 163 is substantially in contact with second deactivating surface 112. Thus, a marker located on broad surface 164 of the video cassette 160 will be deactivated by first surface 110 and the corresponding first magnetic insert 130. The deactivating magnetic field produced by the second magnetic insert 140 will successfully deactivate a marker placed in the recessed portion 162 of side edge 163, due to the lower magnetic field gradient of the second magnetic insert.

FIG. 3B shows a typical audio cassette 170 placed on the present deactivating device 100 such that the raised side portion 172 of the audio cassette is placed in notched edge 120 and such that the surface 174 lies flat against the first deactivating surface 110. Notched edge 120 insures that flat surface 174 of audio cassette 170 is placed flat against first deactivating surface 110. This ensures that a marker located anywhere on flat surface 174 will be properly deactivated. Second, notched edge 120 also insures that a sufficient distance is maintained between the audio cassette 170 and the second magnetic insert 140 such that the magnetic field produced thereby does not cause perceptible (audible) levels of signal degradation of the prerecorded magnetic media contained within the audio cassette.

The marker 10 is typically constructed of an elongated strip of a high permeability, low coercive force ferromagnetic material such as permalloy, certain amorphous alloys, or the like. The strip is further provided with a plurality of higher coercive force magnetizable sections. These sections are typically formed of a material such as vicalloy, arnochrome, silicon steel or the like, typically having a coercive force in the range of 50 to 240 Oersteds. When such sections are magnetized, the relatively strong magnetic fields provided thereby, at the ends of the sections magnetize adjacent portions of the low-coercive-force strip and substantially alter the signal response produced in the presence of an interrogating field. The magnetization of the sections is effected upon exposure to the fields provided by the magnet in first magnetic insert 130 or second magnetic insert 140 when those sections are brought into close proximity with the magnet.

Figure 4:
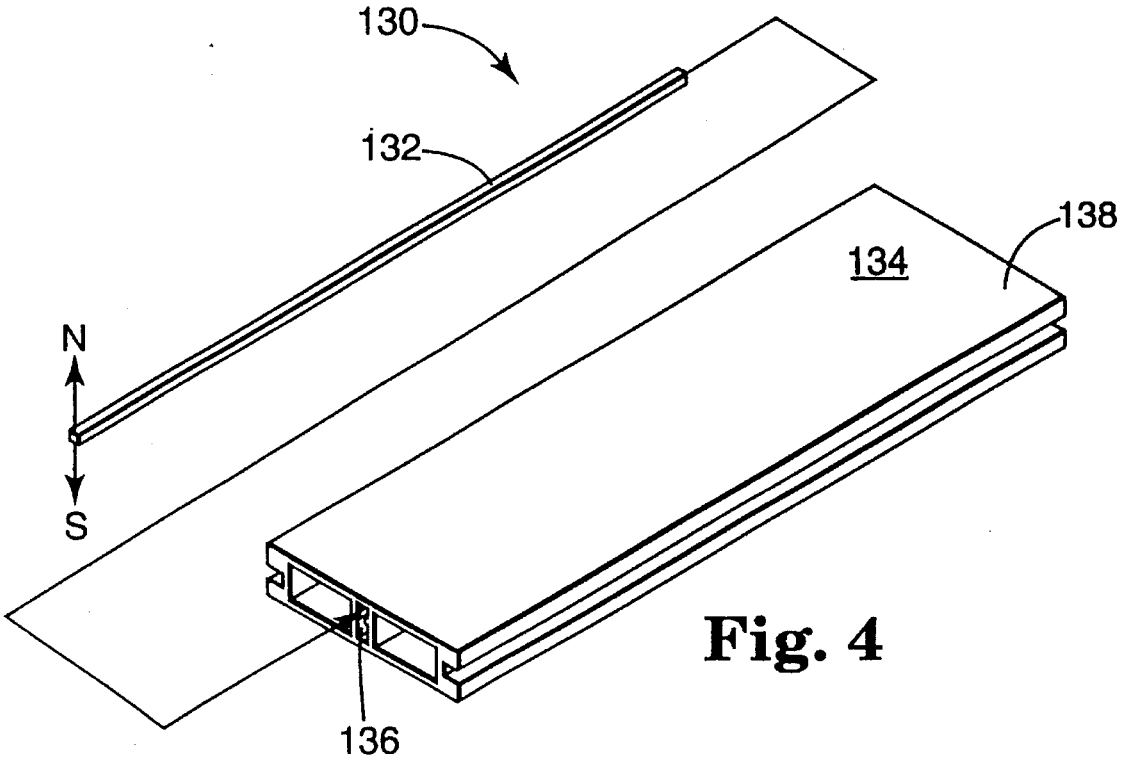
FIG. 4 shows the first magnetic insert of a first embodiment of the present deactivating device.

FIG. 4 shows a perspective view of first magnetic insert 130. A first magnet 132 is preferably positioned in guide 136 of non-magnetic insert body 134 such that first magnet 132 is oriented so that the length is substantially perpendicular with the direction of travel of the article to be deactivated. The length of the first magnet 132 is preferably within the range of from about 1 to 21 cm, and preferably about 7 cm. First magnet 132 is substantially uniformly magnetized in a direction perpendicular to its long dimension such that its north pole is oriented toward top surface 138 of insert body 134. First magnet 132 provides magnetic field components which are aligned substantially normal to its length because of its substantially uniform distribution of north and south poles located on opposite surfaces of the magnet.

The spatial distribution of the magnetic field components originating from magnet 132 are primarily determined by the remanent magnetization or residual induction of the magnet material, and the width and thickness of the magnet. The magnet material, and the width and thickness, are therefore selected so that magnet 132 provides both a large magnetic field, and a large magnetic field gradient. The large magnetic field gradient is necessary to provide sufficient magnetic field at the surface of magnetic insert 130 while avoiding levels of magnetic field at the relatively close prerecorded magnetic media within an audio or video cassette which would result in undesirable levels of signal degradation.

To provide the desired performance, the first magnet 132 preferably has a substantially square-shaped cross-sectional area perpendicular to its length with both width and thickness dimensions within a range from about 0.5 mm to about 2.0 mm, and more preferably about 1 mm. The first magnet 132 preferably has a residual induction in the range of 10,000 to 12,500 Gauss, and more preferably in the range of about 12,000 to 12,500 Gauss. The first magnet 132 has a peak magnetic energy product in the range of about 20 to 45 Megagauss-oersteds, more preferably in the range of about 30 to 40 Megagauss-oersteds, and most preferably about 35 Megagauss-oersteds. Preferred magnet materials include rare earth, transition metal alloys, such as neodynium-iron-boron. A preferred neodynium-iron-boron elongated magnet having a peak energy product of 35 Megagauss-oersteds, and a residual induction of 12,200 Gauss, is available as ND-35 from Dexter Permag, Dexter Magnetic Materials Division, Chanhassen, Minn.

The first magnetic insert 130 therefore provides magnetic field components in the range from 100 to 500 Oe at a spacing of up to 2 mm from the deactivating surface 110. Preferably, first magnetic insert produces magnetic field components of about 500 Oe at a spacing of about 0 min. First insert 130 produces magnetic field components less than 100 Oe at normal spacing from surface 110 exceeding 2 min.

Figure 5:
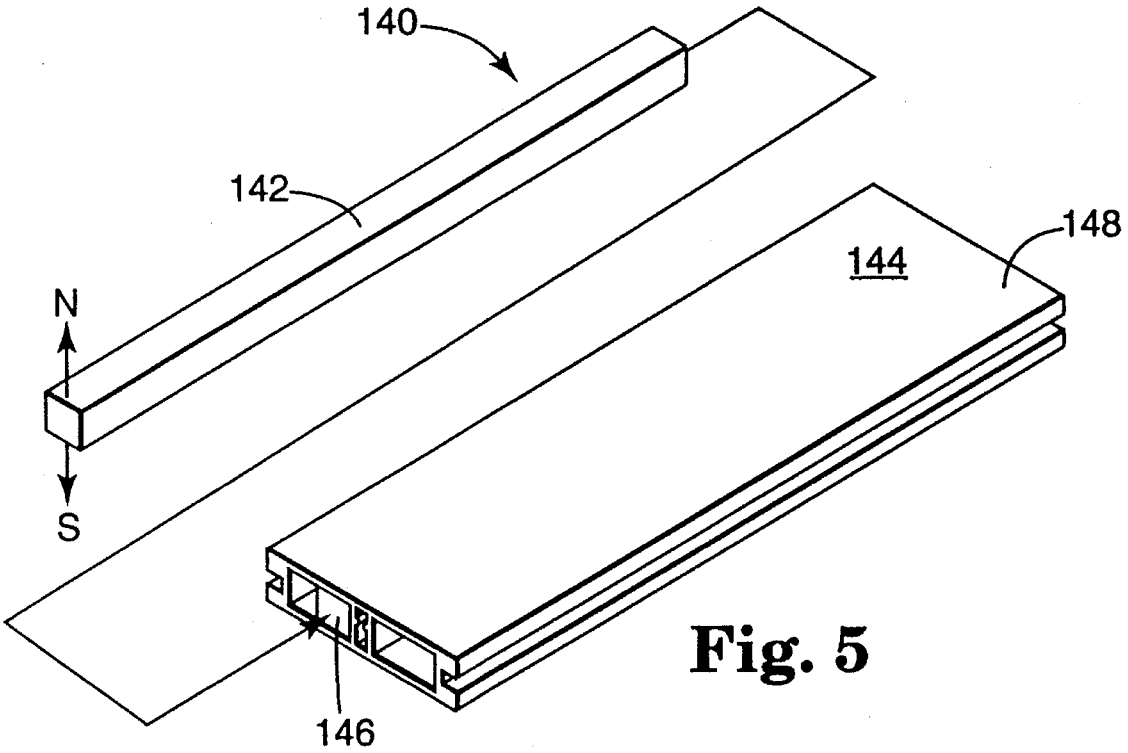
FIG. 5 shows the second magnetic insert of the first embodiment of the present deactivating device.

FIG. 5 shows a perspective view of second magnetic insert 140. A second magnet 142 is preferably positioned in guide 146 of non-magnetic insert body 144 such that second magnet 142 is oriented so that the length is substantially perpendicular with the direction of travel of the marker to be deactivated. Magnet 142 is substantially uniformly magnetized in a direction perpendicular to its long dimension such that its north pole is oriented toward top surface 148 of insert body 144.

Like the first magnet 132 described above, the second magnet 142 provides magnetic field components which are aligned substantially normal to its length because of its substantially uniform distribution of north and south poles located on opposite surfaces of the magnet. Also, like the first magnet 132, the spatial distribution of the magnetic field components produced by the second magnet 142 is primarily determined by the remanent magnetization or residual induction of the magnet material, and the width and thickness of the magnet. Magnet 142 preferably has a rectangular cross-section, the width being larger than the thickness, such that the magnetic field gradient is not as large as for magnet 132. The smaller magnetic field gradient is necessary because of increased spacing between the marker and deactivating surface 112 when the marker is located in the recessed edge 162 of a video cassette 160 (see FIG. 2A), and is tolerable because the magnetic tape in the video cassette is further from the cassette surface, and also because the magnetic tape in the video cassette is commonly of higher coercive material and more resistant to signal degradation by magnetic fields than that of a typical audio cassette. The width of second magnet 142 is preferably in the range from about 0.2 to 0.5 cm, and more preferably about 3.35 mm, and the thickness of second magnet 142 is preferably in the range of about 0.15 to 0.4 cm, and more preferably about 2.0 mm. Because of the larger cross-section dimensions of second magnet 142, a magnet material with a residual induction in the range of about 6000 to 8000 Gauss, and preferably in the range of about 6500 to 7000 Gauss, is selected to avoid exposing the prerecorded video tapes to levels of magnetic fields which would result in an undesirable amount of signal degradation.

The length of the second magnet 142 is preferably within the range of from about 1 to 4 cm, and preferably about 3 cm. The second magnet 142 has a peak magnetic energy product in the range of about 8 to 12 Megagauss-oersteds, and more preferably about 10 Megagauss-oersteds. Preferred magnet materials include rare earth, transition metal alloys, such as neodynium-iron-boron. A preferred neodynium-iron-boron elongated magnet having a peak energy product of 10 Megagauss-oersteds, and a residual induction of 6800 Gauss, is available as ND-10 from Dexter Permag, Dexter Magnetic Materials Division, Chanhassen, Minn.

The second magnetic insert 140 therefore provides magnetic field components in the range from 285 to 540 Oe at a spacing up to 1.7 mm from deactivating surface 112, and preferably about 540 Oe at a spacing of about 0 mm. Second magnetic insert 140 produces magnetic field components less than 260 Oe at normal spacing from surface 112 exceeding 2 mm, and preferably producing magnetic field components less than 100 Oe at normal spacing from surface 112 exceeding 4 mm.

In some cases, the magnet material selected, or commercially available, for use as first magnet 132 or second magnet 142 may have a saturation induction higher than the preferred range, and may provide magnetic field components which are too large to avoid perceptible degradation of the prerecorded signal in the audio or video cassette to which the EAS marker is attached. These magnets may be cut or machined to the required dimensions, and calibrated to provide the desired residual magnetic induction and associated magnetic field components. The calibration process involves magnetizing the magnet to saturation along its preferred axis of magnetization, and then gradually reducing its residual induction from its maximum level to a lower level which provides magnetic field components of the desired levels, both at the deactivating surface and at the closest spacing where the prerecorded magnetic media will be present. The calibration procedure applies a gradually increasing (from zero) alternating polarity magnetic field along the magnetization axis, which increases in magnitude until the measured magnetic field from the magnet has been reduced to the desired level. An additional advantage in using magnets calibrated in this way is the stability of the magnetic fields they provide. Permanent magnets in their maximum residual induction state are more vulnerable to changes in residual induction resulting from exposure to low-level magnetic fields from other magnets, so the magnetic field from these magnets may decrease below the specified levels as a result. The calibrated magnets have already been exposed to low level alternating magnetic fields during the calibration process and are resistant to further changes as a result of such exposure.

Figure 6:
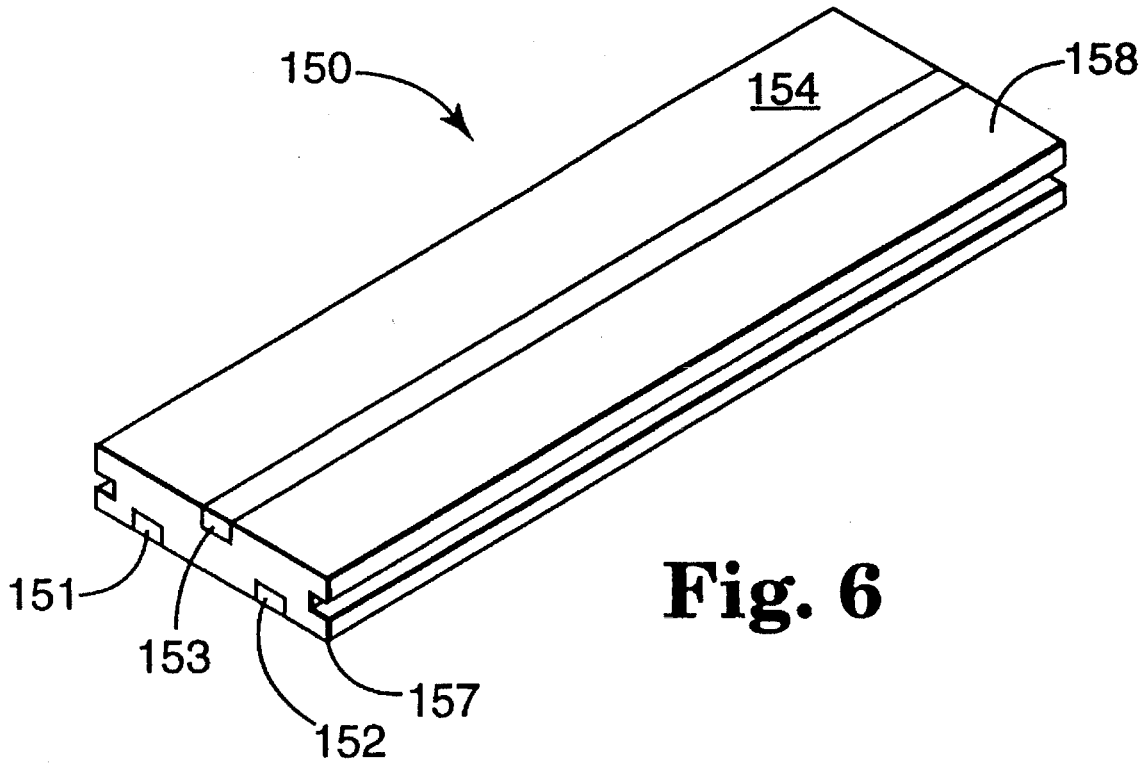
FIG. 6 shows a second embodiment of a magnetic insert used in place of the first and second magnetic inserts of FIGS. 4 and 5.

FIG. 6 shows an alternate preferred magnetic insert 150. In an alternate embodiment of the present deactivating device 100, insert 150 is substituted in the device shown in FIG. 1 for first and second magnetic inserts 130 and 140. Insert 150 includes three magnets 151, 152 and 153 positioned in non-magnetic insert body 154 such that their length is oriented substantially perpendicular to the direction of travel of the article over the present deactivating device. Magnet 153 is preferably positioned so that the top surface of magnet 153 is substantially in the plane of the top surface 158 of insert body 154. Magnets 151 and 153 are preferably positioned such that their bottom surface is substantially in the plane of the bottom surface 152 of insert body 154. The magnets 151, 152 and 153 are preferably constructed of rare earth, transition metal alloys such as neodymium-iron-boron alloys. The length of magnets 151,152, and 153, will depend on whether insert 150 is to be installed in place of insert 130 or 140 in FIG. 1. If magnets 151, 152, and 153 are to replace first magnet 132 of first magnetic insert 130, the lengths will preferably fall within the same dimensional ranges as magnet 132. Similarly, if magnets 151, 152, and 153 are to replace second magnet 142 of second magnetic insert 140, the lengths will preferably fall within the same dimensional ranges as magnet 142. Magnets 151, 152, and 153 typically have a rectangular cross-section, with width in the approximate range of 0.5 to 2 mm, and preferably about 1 mm, and thickness in the approximate range of 0.5 to 2 mm, and preferably about 1 mm. Magnets 151, 152 and 153 are substantially uniformly magnetized across the width of the magnet, providing substantially uniform distributions of north and south poles on opposite sides of the magnet. Magnets 151, 152 and 153 preferably have a residual induction of 10,000 to 12,000 Gauss, and a peak magnetic energy product of at least 30 Megagauss-oersteds. A preferred neodynium-iron-boron elongated magnet having a peak magnetic energy product of 35 Megagauss-oersteds, and a residual induction of 12,200 Gauss, is available as ND-35 from Dexter Permag, Dexter Magnetic Materials Division, Chanhassen, Minn.

Figure 7A:
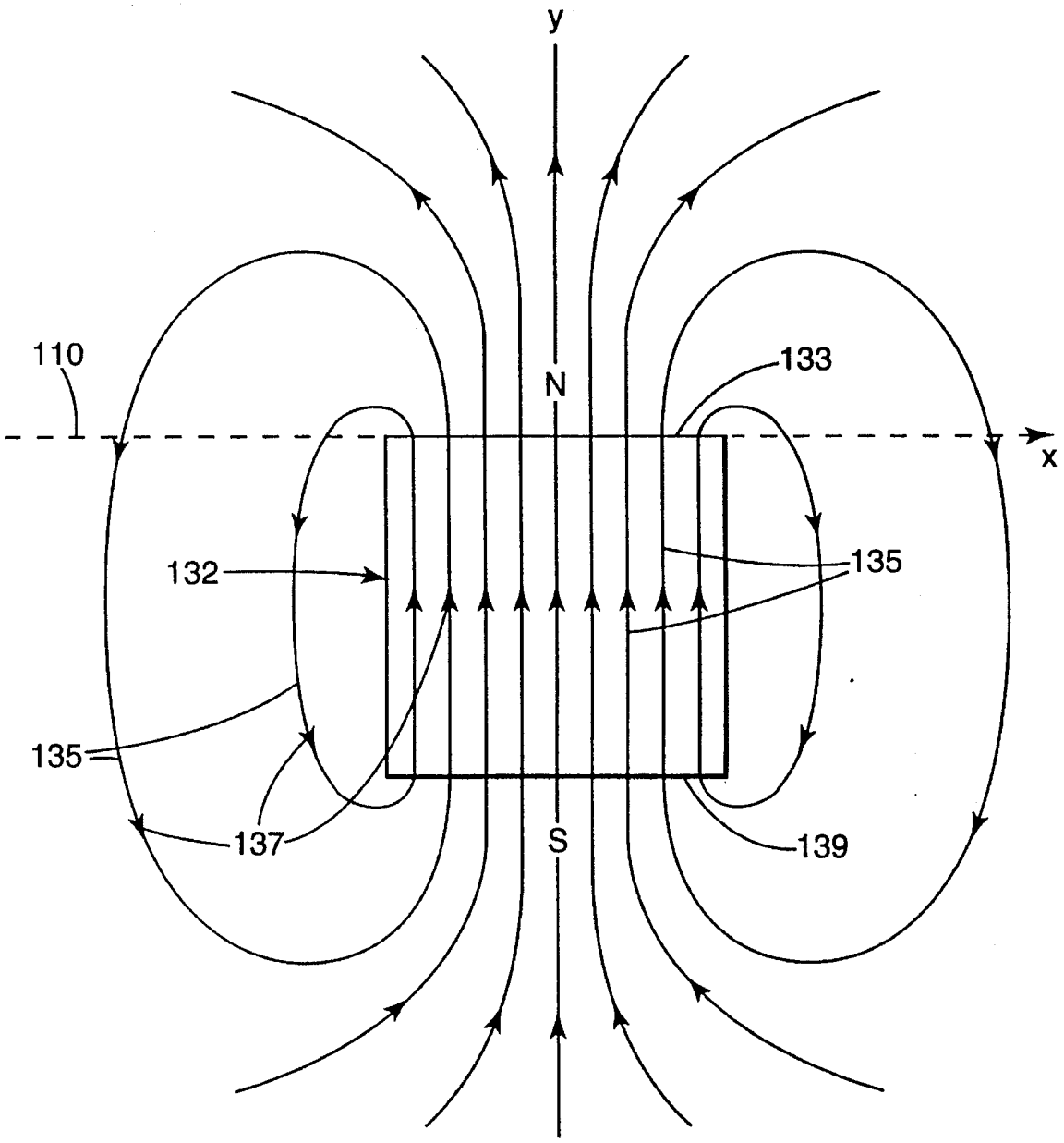
FIG. 7A shows an end view of the magnetic field distribution of the first magnet.

FIG. 7A illustrates an end view of the magnetic field distribution from first magnet 132, where surface 133 is the surface of magnet 132 which is substantially coplanar with first deactivating surface 110 (shown dashed) of deactivating device 100. Parallel, uniformly spaced lines 135 of magnetic flux are shown to represent the uniformly magnetized region within magnet 132, with arrowheads 137 indicating the direction of the associated magnetic field. Surface 133 of magnet 132 is characterized by a substantially uniform distribution of magnetic north poles and opposite surface 139 is characterized by a substantially uniform distribution of magnetic south poles. The magnetic flux lines 135' diverge as they emerge from the pole surfaces of the magnet, extending continuously from north pole surface 133 to south pole surface 139. Based on a coordinate system with the x and y directions as shown in FIG. 7A, and the origin at the center of magnet surface 133, the x-component of magnetic field, $H_x$, is positive (or zero) for positive x values, and negative (or zero) for negative x values.

Figure 7B:
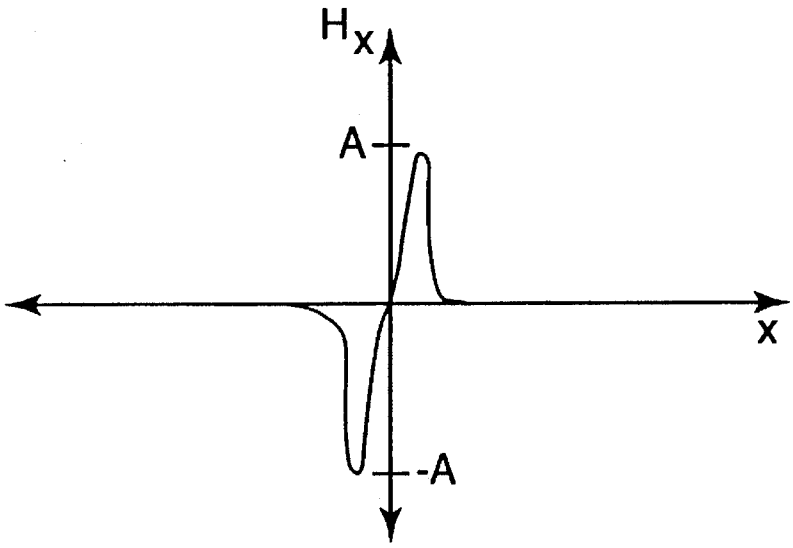
FIGS. 7B and 7C show a plot of the x- component of the magnetic field vs. x produced by the first and second magnetic inserts of FIGS. 4 and 5, respectively, where x is in the direction of relative motion of the marker.

FIG. 7B shows a plot of the x-component of the magnetic field, $H_x$, as a function of x for first magnet 132. As the marker passes along the surface of the first deactivating surface 110 of the present deactivating device, in either direction along axis 116, it is subjected to fields from magnet 132 whose x-component, $H_x$, increases in magnitude to a maximum value of 430 Oe as the marker approaches the near edge of magnet 132. As the marker passes from the near edge to the far edge of magnet 132, $H_x$ decreases in magnitude, reverses direction, and then increases until reaching its maximum magnitude approximately at the far edge of the magnet. As the marker moves away from the far edge of magnet 132, the magnitude of $H_x$ slowly decreases to zero without again reversing direction. Therefore, the marker encounters only a single reversal of the direction of $H_x$, after which it is subjected to a field of maximum magnitude, and it does not subsequently encounter any level of $H_x$ in the opposite direction to partially demagnetize its remanently magnetizable elements. Unlike the magnetic field provided by magnets known in the art, it is believed that the decreasing magnetic field strength of the final (and only) reversal of the first and second magnets increases, rather than decreases, the magnetization of the marker.

Figure 7C:
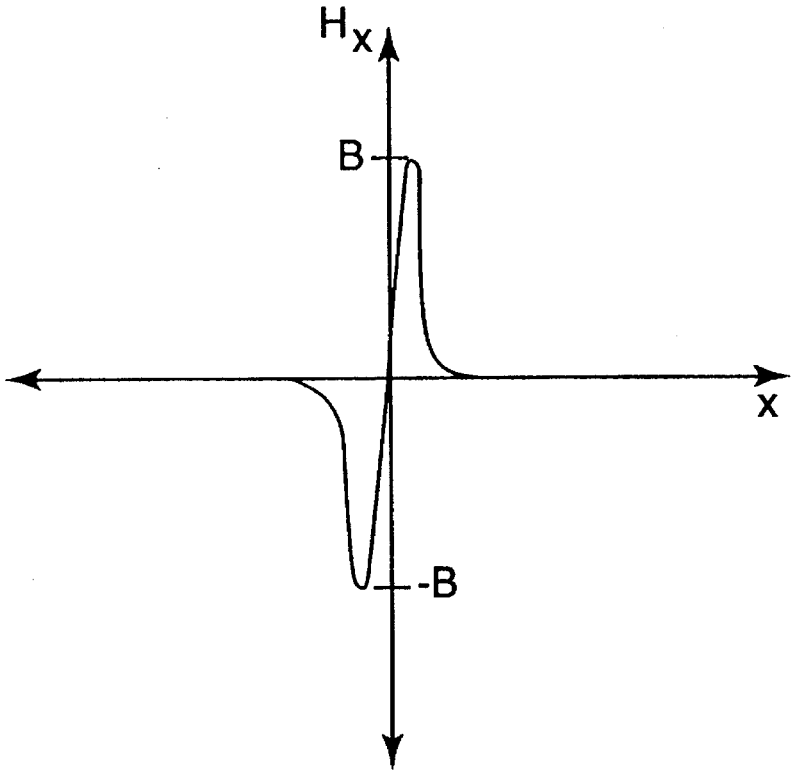

FIG. 7C shows a plot of the x-component of the magnetic field, $H_x$, as a function of x for second magnet 142. The magnetic flux distribution for magnet 142 (not shown) is similar to the distribution shown for first magnet 132 in FIG. 7A. The $H_x$ curve of FIG. 7C is also similar to the curve in FIG. 7B for magnet 132, differing primarily in a maximum magnitude of 520 l Oe for $H_x$ and the locations of the peak magnitude values.

The strength of the magnetic field over the first and second magnets 132 and 142 decreases by a factor of about $1/r^2$, for r greater than 1 mm in the case of first magnet 132, or 2 mm in the case of the second magnet 142, where r is a distance above the magnet. This enables a marker to be remanently magnetized without altering the magnetic state of a prerecorded magnetic media such as audio or video cassettes. On a typical audio cassette, the prerecorded magnetic media may be as near as 0.9 mm from the flat surface 170 on which a marker 10 is placed. The field produced by first magnet 132 has thus dropped off to no more than 100 Oe at a distance to where the magnetic media is located. This level may cause print through levels of up to 0.25% of the maximum amplitude of the recorded signal. However, print through levels of 1.25% of the maximum amplitude are required before they are perceptible by the human ear. Thus, the present deactivating device inserts 130 and 140 produces effects which are about one-fifth that which is perceptible by humans.

Figure 8A:
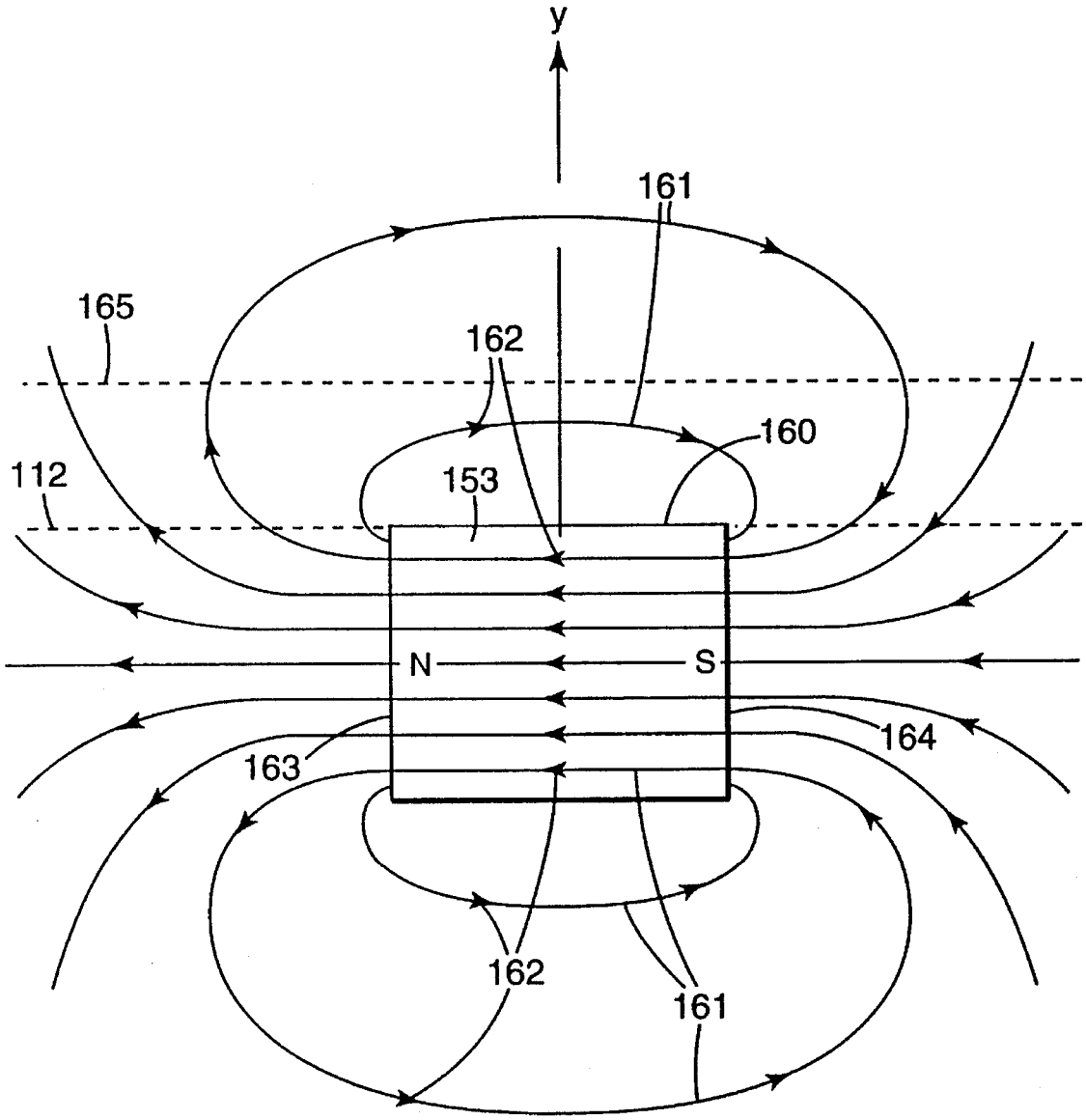
FIG. 8A shows an end view of the magnetic field distribution of the second magnet.

A different type of field is produced by the alternate magnetic insert 150 of FIG. 6. FIG. 8A illustrates an end view of the magnetic field distribution from magnet 153, where surface 160 is the surface which is substantially coplanar with the associated first or second deactivating surface, 110 or 112, of deactivating device 100. Parallel, uniformly spaced lines 161 of magnetic flux are shown to represent the uniformly magnetized region within magnet 153, with arrowheads 162 indicating the direction of the associated magnetic field. Also shown are opposite surfaces 163 and 164 of magnet 153, which are mutually perpendicular to surface 160. Surface 163 is characterized by a substantially uniform distribution of magnetic north poles and opposite surface 164 is characterized by a substantially uniform distribution of magnetic south poles. The magnetic flux lines 161' diverge as they emerge from the pole surfaces of the magnet, extending continuously from north pole surface 163 to south pole surface 164. Based on a coordinate system with the x and y directions as shown in FIG. 7B, and the origin at the center of magnet surface, the x-component of magnetic field has only positive values above surface 160 for positive or negative x values lying between magnet surfaces 163 and 164. However for positive and negative x values beyond the extent of magnet 153, there are regions where the x-component of the magnetic field is negative. These negative field or "backfield" values can have the effect of partially demagnetizing the remanently magnetizable elements of the marker, and thus reactivating the marker.

An end view of the magnetic field distribution from magnets 151 and 152 would resemble the end view of magnet 153 in FIG. 8A, except that the deactivating surface 110 or 112 would be spaced above in position 165 (shown dashed), rather than coplanar with magnet surface 160. At the position 165 surface, the range of positive or negative x values for which the x-component of magnetic field, $H_x$, is positive is somewhat expanded, but the magnitude of $H_x$ is substantially decreased. The "backfield" regions beyond the extent of magnet 151 and 152 are still present at position 165, but the magnitudes of these otherwise detrimental fields are reduced to negligible levels.

Figure 8B:
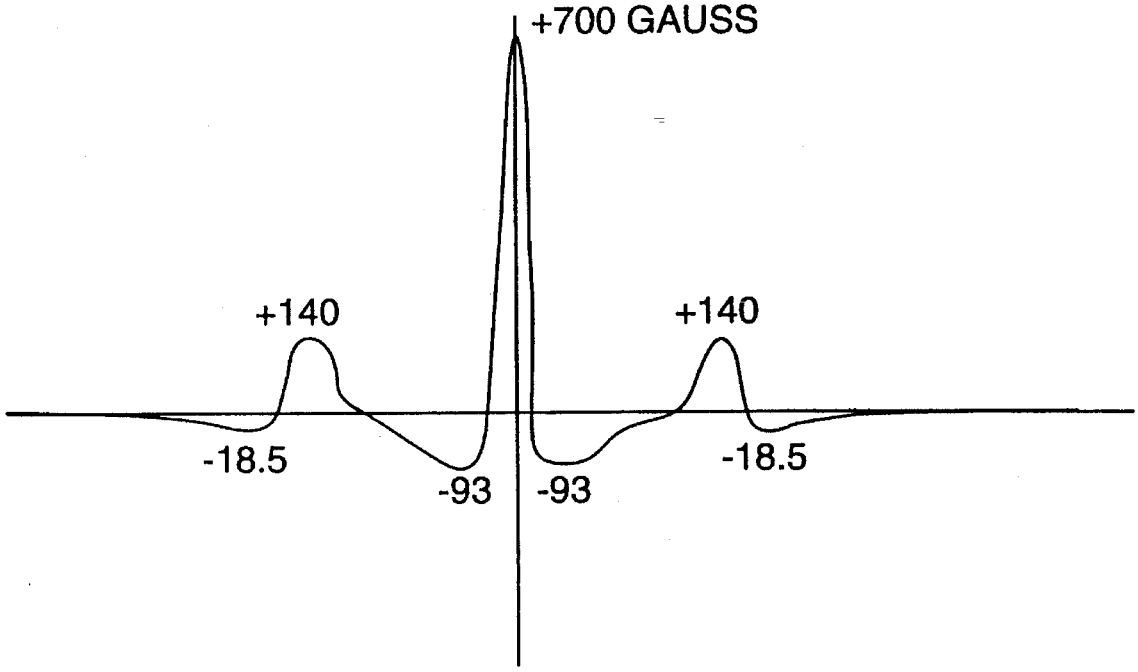
FIG. 8B shows a plot of the x- component of the magnetic field vs. x produced by the insert of FIG. 6, where x is the direction of relative motion of a marker.

FIG. 8B shows a plot of the x-component of the magnetic field, $H_x$, as a function of x for magnet insert 150, comprising three magnets 151, 152, and 153, as shown in FIG. 6. Each of the magnets 151, 152, and 153 contributes a separate segment to the $H_x$ curve, the center magnet 153 having a large narrow peak field above its center portion and smaller broader back field portions on opposite sides of the peak. The end magnets, 151 and 152, installed with their closest surface about 0.6 mm below deactivating surface 110, each provide a peak field in the same direction as the peak field of magnet 153, but their peak field is of significantly lower magnitude. The back field regions on opposite sides of magnets 151 and 152 are also of significantly lower magnititude than those of magnet 153. As the marker passes along the deactivating surface 110, in either direction along axis 116, it is first subjected to a "backfield" of about 18 Oe from the nearest end magnet, 151 or 152, and then subjected to a "positive" magnetic field (i.e. in the intended direction) of about 140 Oe as it passes over the nearest end magnet. It is subsequently subjected to a low-level backfield from the nearest end magnet, 151 or 152, and then the backfield exposure increases to about 140 Oe as the marker moves into the backfield from magnet 153. The marker continues to move into the large positive magnetic field of 700 Oe above the center of magnet 153, saturating the remanently magnetizable segments. As the markers move beyond the maximum field region, they move into the other (140 Oe) backfield region associated with magnet 153, reducing the magnetization of the magnetizable segments to a level at or below their desired maximum remanently magnetized state, which is restored when the marker moves further, passing through the positive magnetic field region of the other outer magnet, 151 or 152. The final exposure to the 18 Oe backfield of the outer magnet has negligible effect on the remanently magnetized elements of the marker or on it deactivated status.

We claim:

1. A deactivating device for magnetic markers in an electronic article surveillance system, comprising:

a housing having first and second intersecting surfaces to support articles having a marker affixed thereto, wherein the first and second surfaces are further adapted to constrain the articles in defined orientations as the articles are moved across the housing;

the first surface further including a first magnet having a length substantially perpendicular to a direction in which the article is moved across the housing, wherein the first magnet provides a deactivating magnetic field component aligned substantially normal to its length and perpendicular to the first surface, the deactivating magnetic field component having a magnitude and gradient which deactivates a marker affixed to the article and placed in contact with the first surface as the article is moved across the housing, without causing audible signal degradation of prerecorded magnetic media contained in the article to which the marker is affixed;

the second surface further in including a second magnet having a length substantially perpendicular to the direction in which the article is moved across the housing, wherein the second magnet provides a deactivating magnetic field component aligned substantially normal to its length and perpendicular to the second surface, the deactivating magnetic field component having a magnitude and gradient which deactivates a marker affixed in a recessed portion of an article without causing audible signal degradation of prerecorded magnetic media contained in the article to which the marker is affixed.

2. The deactivating device of claim 1 wherein the first deactivating surface further includes a notched edge adapted to accommodate a raised side portion of an audio cassette.

3. The deactivating device of claim 1 wherein the second deactivating surface further includes a protruding edge adapted to accommodate a side edge of a video cassette.

4. The deactivating device of claim 3 wherein the protruding edge further prevents placement of a vertically positioned audio tape in close proximity to the second deactivating surface.

5. The deactivating device of claim 1, wherein the first and second magnets comprise rare earth, transition metal alloys.

6. The deactivating device of claim 5, wherein the first and second magnets comprise neodynium-iron-boron.

7. The deactivating device of claim 1, wherein the first magnet has a residual induction in the range of 10,000–12,500 Gauss.

8. The deactivating device of claim 1, wherein the second magnet has a residual induction in the range of 6,000–8,000 Gauss.

9. The deactivating device of claim 1, wherein the first magnet has a rectangular-shaped cross-section perpendicular to its length having dimensions of less than 2 mm by 2 min.

10. The deactivating device of claim 1, wherein the second magnet has a rectangular-shaped cross-section perpendicular to its length having dimensions of less than 5 mm by 4 min.

11. A deactivating device for markers in an electronic article surveillance system, comprising:

a housing having first and second orthongonally intersecting surfaces adapted to support articles having markers affixed thereto, wherein the first and second surfaces are further adapted to constrain the articles in defined orientations as the articles are moved across the housing, the first and second surfaces both further including:

parallel spaced apart first and second magnets positioned with their top surfaces defining a plane below and substantially parallel with the plane of the associated first or second surfaces, and a third magnet positioned with its top surface parallel to the plane of the associated first or second surface, wherein each of the first, second and third magnets have lengths substantially perpendicular to a direction of travel of the marker as the articles are moved across the housing, wherein each magnet provides a deactivating magnetic field component aligned substantially normal to its length and parallel to the associated first or second surface.

12. The deactivating device of claim 11 wherein the first deactivating surface further includes a notched edge adapted to accommodate a raised side portion of an audio cassette.

13. The deactivating device of claim 11 wherein the second deactivating surface further includes a protruding edge adapted to accommodate a side edge of a video cassette.

14. The deactivating device of claim 13 wherein the protruding edge further prevents placement of a vertically positioned audio tape in close proximity to the second deactivating surface.

15. The deactivating device of claim 11, wherein each magnet has a peak magnetic energy product of at least about 25 Megagauss-oersteds and is substantially uniformly magnetized having a substantially uniform distribution of north and south poles located on opposite surfaces of the magnet.

16. The deactivating device of claim 11, wherein the first, second and third magnets comprise rare earth, transition metal alloys.

17. The deactivating device of claim 16, wherein the first, second and third magnets comprise neodynium-iron-boron.

18. The deactivating device of claim 11, wherein the first, second and third magnets each have a rectangular-shaped cross-sectional area perpendicular to their length of less than about 1.5 mm by 1.5 mm.

19. The deactivating device of claim 11, wherein the plane of the third magnet is coplanar with the surface adapted to support the article.

20. A deactivating device for magnetic markers in an electronic article surveillance system, comprising:

a housing having first and second intersecting surfaces for supporting an article having a marker affixed thereto, wherein the first surface further includes a notched edge adapted to accommodate a raised side portion of the article, and further wherein wherein the first surface further includes a first magnet oriented to provide a deactivating magnetic field component aligned substantially normal to the length of the first magnet and perpendicular to the first surface, the deactivating magnetic field component having a magnitude and gradient which deactivates the marker affixed to the article without causing audible signal degradation of prerecorded magnetic media contained in the article.

21. The deactivating device according to claim 20, wherein the second surface further includes a protruding edge adapted to accommodate a side edge of the articles, and further wherein the second surface further includes a second magnet oriented to provide a deactivating magnetic field component aligned substantially normal to the length of the second magnet and perpendicular to the second surface, the deactivating magnetic field component having a magnitude and gradient with deactivates a marker affixed a recessed portion in the side edge of the article without causing audible signal degradation of prerecorded magnetic media contained in the article.

* * * * *

UNITED STATES PATENT AND TRADEMARK OFFICE

CERTIFICATE OF CORRECTION

PATENT NO.: 5,477,202

DATED: December 19, 1995

INVENTOR(S): Peter J. Zarembo, Thomas J. Brace and John H. Kindschy

It is certified that error appears in the above-identified patent and that said Letters Patent is hereby corrected as shown below:

Col. 2, line 22, line 32, "et at." should read --et al.--.

Col. 5, lines 7-8, "reactivation" should read --deactivation--.

Col. 6, line 66, "min." should read --mm--.

Col. 7, line 2, "min." should read --mm--.

Col. 9, line 49, "520 1 Oe" should read --520 Oe--.

Col. 11, line 33, "in" should be deleted.

Col. 12, line 2, "min." should read --mm--.

Col. 12, line 6, "min." should read --mm--.

Col. 13, line 5, "articles" should read --article,--.

Col. 14, line 3, "with" should read --which-- and after "affixed" insert --in--.

Signed and Sealed this

Twenty-ninth Day of July, 1997

Bruce Lehman

*Attest:*

BRUCE LEHMAN

*Attesting Officer*

*Commissioner of Patents and Trademarks*